United States Patent [19]

Sausner et al.

[11] Patent Number: 4,562,809

[45] Date of Patent: Jan. 7, 1986

[54] DEVICE FOR REGULATING THE IDLING SPEED OF AN INTERNAL COMBUSTION ENGINE

[75] Inventors: Andreas Sausner, Frankfurt am Main; Gerhard Ruschek, Hattersheim, both of Fed. Rep. of Germany

[73] Assignee: VDO Adolf Schindling AG, Frankfurt am Main, Fed. Rep. of Germany

[21] Appl. No.: 762,016

[22] Filed: Aug. 1, 1985

Related U.S. Application Data

[63] Continuation of Ser. No. 626,096, Jun. 29, 1984, abandoned.

[30] Foreign Application Priority Data

Jul. 15, 1983 [DE] Fed. Rep. of Germany ..... 3325548

[51] Int. Cl.[4] ..... F02D 33/02

[52] U.S. Cl. ..... 123/339; 251/77; 123/585

[58] Field of Search ..... 123/339, 58 J; 251/77, 251/79, 80, 83; 60/527, 528; 74/860; 261/50 A, 52, 78 R, 50, 3, DIG. 19; 137/591.1, 544, 550

[56] References Cited

U.S. PATENT DOCUMENTS

| | | | |
|---|---|---|---|
| 1,697,953 | 1/1929 | French | 251/77 |
| 1,944,113 | 1/1934 | Shandon | 251/77 |
| 2,783,019 | 2/1957 | Houghton | 251/77 |
| 2,797,061 | 6/1957 | Buchanan | 251/77 |
| 2,868,494 | 1/1959 | Kearns, Jr. et al. | 251/77 |
| 2,980,139 | 4/1961 | Lynn | 251/77 |
| 3,384,886 | 6/1968 | Tissot-Dupont | 251/77 |
| 3,996,908 | 12/1976 | Brown et al. | 123/585 |
| 4,142,707 | 3/1979 | Bjorklund | 251/77 |
| 4,168,680 | 9/1979 | Kawai et al. | 123/339 |
| 4,250,709 | 2/1981 | Conrad et al. | 123/339 |

*Primary Examiner*—Raymond A. Nelli

*Attorney, Agent, or Firm*—Martin A. Farber

[57] ABSTRACT

In a device for regulating the idling speed of an internal combustion engine by controlling the feed, having an electromechanical setting member, there are provided an electric drive member (core 1, coil 2) and at least one magnetic flux-conducting element (push rod 3) between the drive member and a valve element (impact plate 8) and at least one return spring (6) which acts on the drive member. In order to avoid, as far as possible, any rebound of the sealing member, a prestressed decoupling spring 7 is arranged between the magnetic flux conducting element (push rod 3) and the valve element (impact plate 8) and an opposing spring (9) acts directly on the valve element (impact plate 8).

9 Claims, 1 Drawing Figure

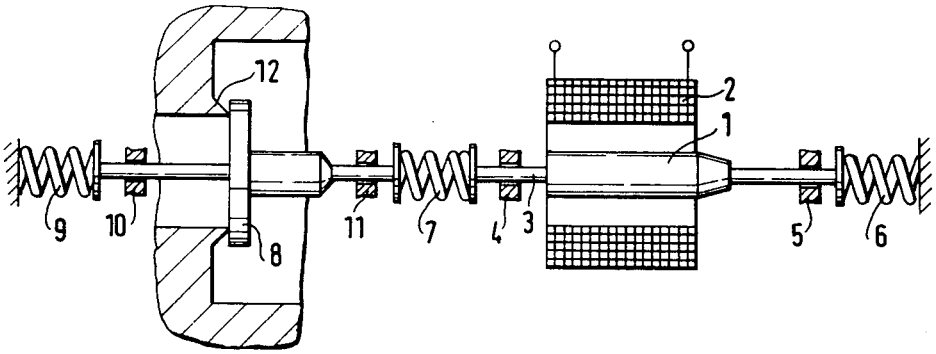
12
2
1
9
10
8
11
7
4
3
5
6

DEVICE FOR REGULATING THE IDLING SPEED OF AN INTERNAL COMBUSTION ENGINE

This application is a continuation of application Ser. No. 626,096, filed 06/29/84, and abandoned.

FIELD AND BACKGROUND OF THE INVENTION

The invention relates to a device for regulating the idling speed of an internal combustion engine.

The device for regulating the idling speed of an internal combustion engine by controlling the feed has an electromechanical setting member which is provided with an electric drive member and at least one magnetic-flux-conducting element between the drive member and a valve element and has at least one return spring which acts on the drive member.

Devices are used to regulate the idling speed in order, in particular in the case of automotive vehicles, to set the lowest possible speed of rotation which results in favorable consumption and emission values. With constant feed of the internal combustion engine, variations in idling speed may occur due, in particular, to different loads caused by auxiliary units. In addition to this, at low idling speed the operating condition of an internal combustion engine is close to the unstable speed range within which the engine may stall upon further additional load. For this reason, the rate of flow of the air or the feed upon idling is not permanently set but is regulated in accordance with the variations in the idling speed. For this purpose, a solenoid is acted on by a setting current which is formed, inter alia, as a function of the actual speed of rotation and effects such a displacement of the valve element connected to the solenoid that the actual speed of rotation reaches a predetermined desired speed substantially independently of any disturbing variables.

Specifically, known devices for regulating the idling speed are developed in such a manner that when the solenoid is without current the valve element is held, for instance, in closed position by the return spring. Only when the solenoid is acted on by the setting current does the valve element move in opposition to the force of the return spring into a middle position between the fully open and fully closed positions, until equilibrium of forces prevails between the magnetic force and the force of the return spring.

As a rule, the valve element is developed as an impact plate which is movable against knife edges of an idling-air passage opening.

It is desirable to adjust by means of the setting member a minimum mass flow of air, which may, for instance be less than 2 kg/hour. However, the minimum mass flow of air is limited by the fact that, in the prior art development of the devices, every movement of the solenoid as electric drive member was transmitted in rigid fashion to the valve element or an impact plate as sealing member. If, in such an arrangement, the sealing member is moved dynamically against a sealing edge or knife edges, then the sealing member rebounds from the sealing edge and thus produces an undesired opening.

It is an object of the invention so to improve a device of the aforementioned type for regulating the idling speed that it operates accurately, and in particular without rebound, even within the region of small air flows which are to be be set.

SUMMARY OF THE INVENTION

According to the invention, a prestressed uncoupling spring (7) is arranged between the magnetic-flux-conducting element (push rod 3) and the valve element (impact plate 8), and an opposing spring (9) is connected directly (i.e. on this side of the uncoupling spring 7) to the valve element.

In accordance with the principle of the invention, instead of the oscillatable system previously present, consisting, for instance, of a core of a solenoid, a push rod which connects the solenoid to the sealing member or valve element and a return spring, as a result of which this oscillatable system is relatively heavy, two oscillatable systems, each of less weight, are created, in such a manner that the impact behavior of the sealing member or valve element is favorably affected. Specifically, a first oscillatable system consists of the movable part of the electric drive member, in particular a core, with a push rod and a return spring which is connected directly to the movable part of the drive member. "Directly" in this respect means that the return spring does not act on the movable part of the drive member via the decoupling spring provided. The second oscillatable system is separated from this first oscillatable system by the decoupling spring, which can transmit movements and forces from the first oscillatable system to the second oscillatable system. The second oscillatable system consists essentially of the sealing member or valve element, in particular an impact plate, and of an opposing spring, as well as connecting elements or connecting sections which connect the sealing member to the opposing spring on the one hand and the decoupling spring on the other hand. The opposing spring is in this way directly connected to the sealing member.

The two oscillatable systems and the decoupling spring are so dimensioned that, upon periodic excitation of the first oscillatable system, this first system attempts via the decoupling spring, to press the sealing member with increased force against the sealing edge just when the sealing member wants to bounce back from the sealing edge. The force acting on the sealing member which comes from the first oscillatable system is therefore shifted in phase about 180° from the force acting on the sealing member due to the rebound process or the impact between the sealing member and the sealing edge.

In this way, the overall result is obtained that the sealing member does not open periodically in undesired manner in the vicinity of the sealing edge or on the sealing edge even in case of a dynamic control. Thus a precise regulating of the mass flow of idling-air at very small values can be obtained.

It is particularly advantageous if the decoupling spring (7) is developed as a compression spring which is compressed under the action of the return spring (6) and of the opposing spring (9) in condition or rest. The return spring and the opposing spring are therefore used in order to produce the force locking via the decoupling spring in static condition.

The return spring and the opposing spring can, as so-called working springs, be relatively soft while the decoupling spring is relatively hard so as to cause only slight losses in path between the movement of the first oscillatable system with the movable part of the drive member to the second oscillatable system having the sealing member. In this case the ratio of the spring constants of the decoupling spring (7) to that of the return spring (6) and of the opposing spring (9) can amount to 2:1 to 3:1.

The masses of the first oscillatable system and of the second oscillatable system are preferably so dimensioned relative to each other that the back kick exerted on the sealing member by the sealing edge is not greater than the instantaneously exciting force of the first oscillatable system.

The first oscillatable system is periodically excited in known manner also in order to avoid, as far as possible, mechanical hysteresis of the displacement of the movable part of the first system and thus of the sealing member.

BRIEF DESCRIPTION OF THE DRAWING

The invention will be explained below with reference to the drawing which contains only a single FIGURE which shows a preferred embodiment of the device in simplified form, partially in longitudinal section.

DETAILED DESCRIPTION OF THE PREFERRED EMBODIMENT

The drawing shows a core 1 of a solenoid, the solenoid being merely indicated. The solenoid is excited by a coil 2. The solenoid has ferromagnetic parts which conduct the magnetic flux so as to exert a force on the core 1 as a result of the excitation. These ferromagnetic parts which conduct the magnetic flux have, however, not been shown since they do not have any direct effect on the dynamic behavior of the device. The core 1 is mounted displaceably by a push rod 3 at two places 4 and 5. These places can be arranged within the ferromagnetic part which conducts the magnetic flux. One end of the push rod 3 leads to a return spring 6. Another end of the push rod 3 is connected with a decoupling spring 7.

The core 1, the push rod 3 and the return spring 6 form a first oscillatable spring/mass system.

This first oscillatable system is connected via the decoupling spring 7 to a second oscillatable system.

The second oscillatable system comprises a sealing member developed as impact plate 8 which is directly connected to an opposing spring 9. The impact plate is mounted for displacement at places 10 and 11. In its condition of rest and with the coil deenergized it is pressed by the return spring 6 via the decoupling spring 7 against a knife-edge-like sealing edge 12, which defines an idling-air passage opening.

The return spring 6 and the opposing spring 9 are developed as compression springs in order to compress the decoupling spring 7 in static state. The return spring 6 and the counter spring 9 are relatively soft as compared with the decoupling spring 7. Thus the springs 6 and 9 can act as operating springs while the decoupling spring 7 causes only short losses in path.

Upon the operation of the device, the first oscillatable system is excited by the coil 2. The displacement of the push rod 3, which forms a part of this first oscillatable system, is transmitted via the decoupling spring 7 to the second oscillatable system having the impact plate 8. When the impact plate 8 strikes against the sealing edge 12, it is imparted an incomplete elastic push backwards so that there is an undesired tendency for the idling-air passage opening to be momentarily opened. This, however, is prevented by the particularly large force opposite the direction of rebound which is transmitted via the decoupling spring 7 during this phase by the first oscillatable system. For this purpose, therefore, the first oscillatable system and the second oscillatable system are so adapted to each other that in the phase of contact with the sealing edge, the impact plate is imparted by the first oscillatable system an impulse which is shifted 180° in phase and presses the impact plate against the sealing edge. The masses of the first and second oscillatable systems should, in this connection, be so adapted to each other that the backward blow on the impact plate cannot be greater than the exciting force coming from the first system.

As a whole, there is thus obtained a particularly wide usable operating range of the device, which permits exact adjustments, in particular, also in the range of small mass flows of air.

We claim:

1. A device for regulating the idling speed of an internal combustion engine by controlling an air feed via a valve element, the device comprising an electromechanical actuator having a drive member operatively coupling the actuator to the valve element, and at least one return spring which acts on the drive member, the improvement wherein a prestressed decoupling spring is disposed between said drive member and said valve element, and an opposing spring is connected directly to said valve element on a side thereof opposite said return spring.

2. The device as set forth in claim 1, wherein said decoupling spring is a compression spring which is compressed under the action of said return spring and of said opposing spring in a condition of rest.

3. The device as set forth in claim 1, wherein the ratio of the spring constants of the decoupling spring to that of the return spring and of the opposing spring is in the range of 2:1 to 3:1.

4. The device as set forth in claim 2, wherein the ratio of the spring constants of the decoupling spring to that of the return spring and of the opposing spring is in the range of 2:1 to 3:1.

5. A device for regulating the idling speed of an internal combustion engine by controlling an air feed via a valve element which is moveable relative to a sealing edge, the device comprising an electromechanical actuator having a drive member operatively coupling the actuator to the valve element, and at least one return spring which acts on the drive member, the improvement wherein a prestressed decoupling spring is disposed between said drive member and said valve element, and an opposing spring is connected directly to said valve element on a side thereof opposite said return spring.

6. The device according to claim 5, wherein said coupling the actuator to the valve element is a mechanical coupling.

7. A device for regulating the idling speed of an internal combustion engine by control of air feed to the engine, the device comprising:

a valve having a valve element and an opening for passage of air to the engine, said valve element being movable relative to a sealing edge of said opening;

actuator means having a movable core element for displacing said valve element relative to said sealing edge, a return spring operatively coupled to said movable core element for retracting said core element upon a deactivating of said actuator means, said return spring and said actuator means constituting a first oscillative system;

an opposing spring operatively connecting with said valve element for urging said valve element away from said sealing edge, said opposing spring and said valve element constituting a second oscillative system; and a decoupling spring operatively connected between said valve element and said core element, said return spring and said opposing spring and said decoupling spring each being continuously stressed, displacement of said core element being imparted to said valve element via said decoupling spring, whereby said valve element can be brought into contact with said sealing edge while inhibiting a bounce of said valve element from said sealing edge.

8. The device according to claim 7, wherein said actuator means is electromechanical and comprises a solenoid.

9. The device according to claim 8, wherein connection of said opposing spring and said decoupling spring to said valve element is mechanical.

* * * * *